US009004540B2

(12) United States Patent
Rahm et al.

(10) Patent No.: US 9,004,540 B2
(45) Date of Patent: Apr. 14, 2015

(54) SECURITY ELEMENT

(75) Inventors: Michael Rahm, Hemau (DE); Marius Dichtl, Munich (DE); Manfred Heim, Bad Tolz (DE); Hans Lochbihler, Munich (DE); Thomas Kampfe, Jena (DE); Thomas Pertsch, Hermsdorf (DE); Jorg Petschulat, Jena (DE); Ernst-Bernhard Kley, Jena (DE)

(73) Assignee: Giesecke & Devrient GmbH, Munich (DE)

( * ) Notice: Subject to any disclaimer, the term of this patent is extended or adjusted under 35 U.S.C. 154(b) by 607 days.

(21) Appl. No.: 12/809,334

(22) PCT Filed: Dec. 17, 2008

(86) PCT No.: PCT/EP2008/010747

§ 371 (c)(1),
(2), (4) Date: Jun. 18, 2010

(87) PCT Pub. No.: WO2009/083151

PCT Pub. Date: Jul. 9, 2009

(65) Prior Publication Data

US 2010/0307705 A1 Dec. 9, 2010

(30) Foreign Application Priority Data

Dec. 21, 2007 (DE) ..... 10 2007 061 979

(51) Int. Cl.
*B42D 25/328* (2014.01)
*B42D 25/00* (2014.01)
*B42D 25/29* (2014.01)

(52) U.S. Cl.
CPC ..... *B42D 25/00* (2014.10); *B42D 2035/24* (2013.01); *B42D 25/29* (2014.10)

(58) Field of Classification Search
USPC ..... 283/72, 85, 91, 114
See application file for complete search history.

(56) References Cited

U.S. PATENT DOCUMENTS

| | | | | |
|---|---|---|---|---|
| 5,629,070 | A * | 5/1997 | Korth | 359/2 |
| 6,271,967 | B1 * | 8/2001 | Stork | 283/85 |
| 6,602,578 | B1 * | 8/2003 | Tompkin et al. | 283/72 |
| 6,927,885 | B2 * | 8/2005 | Staub et al. | 283/91 |
| 7,295,717 | B2 * | 11/2007 | Hersch et al. | 283/91 |
| 7,667,894 | B2 | 2/2010 | Hoffmuller | |

(Continued)

FOREIGN PATENT DOCUMENTS

| | | | |
|---|---|---|---|
| DE | 10208036 | A1 | 8/2003 |
| DE | 102005062132 | A1 | 7/2007 |

(Continued)

OTHER PUBLICATIONS

Nutley M.C. et al., The moiré magnifier, Pure Appl. Opt. 3:133-142, 1994.

(Continued)

*Primary Examiner* — Kyle Grabowski
(74) *Attorney, Agent, or Firm* — Lathrop & Gage LLP

(57) ABSTRACT

The present invention relates to a security element (20) for security papers, value documents and the like, having a feature region (24) that selectively influences incident electromagnetic radiation (30). According to the present invention, it is provided that the feature region (24) includes metallic nanopatterns (28) in which volume or surface plasmons are excited and/or resonance effects are caused by the incident electromagnetic radiation (30).

44 Claims, 9 Drawing Sheets

(56) References Cited

U.S. PATENT DOCUMENTS

Figure 1:
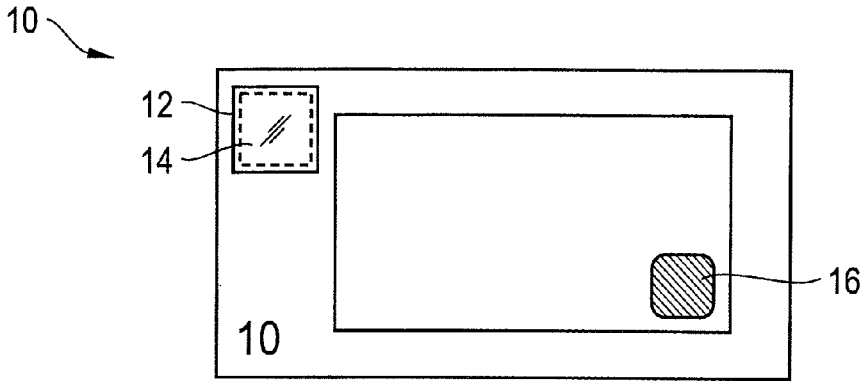

| | | | |
|---|---|---|---|
| 7,728,931 | B2 | 6/2010 | Hoffmuller |
| 7,808,605 | B2 | 10/2010 | Hoffmuller |
| 7,986,459 | B2 | 7/2011 | Kaule |
| 8,083,894 | B2 | 12/2011 | Gruszczynski |
| 8,149,511 | B2 | 4/2012 | Kaule |
| 2004/0026917 | A1 | 2/2004 | Bauer et al. |
| 2005/0001038 | A1 | 1/2005 | Walter et al. |
| 2005/0052650 | A1 | 3/2005 | Wu |
| 2005/0257270 | A1 | 11/2005 | Grassl et al. |
| 2006/0147640 | A1 | 7/2006 | Kastner et al. |
| 2007/0165182 | A1 | 7/2007 | Hoffmuller |
| 2007/0211238 | A1 | 9/2007 | Hoffmuller |
| 2007/0216518 | A1 | 9/2007 | Hoffmuller |
| 2007/0229928 | A1 | 10/2007 | Hoffmuller |
| 2007/0241553 | A1 | 10/2007 | Heim |
| 2007/0246933 | A1 | 10/2007 | Heim |
| 2007/0274559 | A1 | 11/2007 | Depta |
| 2008/0014378 | A1 | 1/2008 | Hoffmuller |
| 2008/0054621 | A1 | 3/2008 | Burchard |
| 2008/0079257 | A1 | 4/2008 | Fessl |
| 2008/0088859 | A1 | 4/2008 | Depta |
| 2008/0160226 | A1 | 7/2008 | Kaule |
| 2008/0163994 | A1 | 7/2008 | Hoppe |
| 2008/0198468 | A1 | 8/2008 | Kaule |
| 2008/0216976 | A1 | 9/2008 | Ruck |
| 2008/0250954 | A1 | 10/2008 | Depta |
| 2008/0258456 | A1 | 10/2008 | Rahm |
| 2009/0001709 | A1 | 1/2009 | Kretschmar |
| 2009/0008923 | A1 | 1/2009 | Kaule |
| 2009/0008926 | A1 | 1/2009 | Depta |
| 2009/0102605 | A1 | 4/2009 | Kaule |
| 2009/0115185 | A1 | 5/2009 | Hoffmuller |
| 2009/0236061 | A1 | 9/2009 | Gruszczynski |
| 2009/0297805 | A1 | 12/2009 | Dichtl |
| 2009/0322071 | A1 | 12/2009 | Dichtl |
| 2010/0175843 | A1 | 7/2010 | Gregarek |
| 2010/0177094 | A1 | 7/2010 | Kaule |
| 2010/0182221 | A1 | 7/2010 | Kaule |
| 2010/0194091 | A1 | 8/2010 | Heim |
| 2010/0194532 | A1 | 8/2010 | Kaule |
| 2010/0196587 | A1 | 8/2010 | Keller |
| 2010/0207376 | A1 | 8/2010 | Heim |
| 2010/0208036 | A1 | 8/2010 | Kaule |
| 2010/0307705 | A1 | 12/2010 | Rahm |
| 2010/0308570 | A1 | 12/2010 | Heim |
| 2010/0320742 | A1 | 12/2010 | Hoffmuller |
| 2011/0000737 | A1 | 1/2011 | Heim |
| 2011/0007374 | A1 | 1/2011 | Heim |
| 2011/0012337 | A1 | 1/2011 | Heim |
| 2011/0027538 | A1 | 2/2011 | Hoffmann |
| 2011/0045248 | A1 | 2/2011 | Hoffmuller |
| 2011/0069360 | A1 | 3/2011 | Dichtl |
| 2011/0079997 | A1 | 4/2011 | Heim |
| 2011/0091665 | A1 | 4/2011 | Heim |
| 2011/0095518 | A1 | 4/2011 | Hoffmuller |
| 2011/0101670 | A1 | 5/2011 | Heim |
| 2011/0109078 | A1 | 5/2011 | Hoffmuller |
| 2011/0114733 | A1 | 5/2011 | Heim |
| 2011/0157183 | A1 | 6/2011 | Kaule |
| 2012/0126525 | A1 | 5/2012 | Dorfler |
| 2012/0168515 | A1 | 7/2012 | Schutzmann |
| 2012/0170124 | A1 | 7/2012 | Fuhse |

FOREIGN PATENT DOCUMENTS

| | | | |
|---|---|---|---|
| DE | 102007029203 | A1 | 1/2009 |
| EP | 1238295 | B1 | 12/2004 |
| WO | WO 94/27254 | A1 | 11/1994 |
| WO | WO 00/18591 | A1 | 4/2000 |
| WO | WO 02/18155 | A2 | 3/2002 |
| WO | WO 03/016073 | A1 | 2/2003 |
| WO | WO 03/061983 | A1 | 7/2003 |
| WO | WO 2004/014663 | A1 | 2/2004 |
| WO | WO 2004/034338 | A1 | 4/2004 |
| WO | WO 2005/052650 | | 6/2005 |
| WO | WO 2005/109077 | A1 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007/076952 | A2 | 7/2007 |
| WO | WO 2007076952 | | 7/2007 |
| WO | WO 2007079851 | | 7/2007 |
| WO | WO 2007115648 | | 10/2007 |
| WO | WO 2007/140484 | A2 | 12/2007 |
| WO | WO 2008/000350 | | 1/2008 |
| WO | WO 2008/000350 | A1 | 1/2008 |
| WO | WO 2008/000351 | | 1/2008 |
| WO | WO 2008/049533 | | 5/2008 |
| WO | WO 2008/061636 | | 5/2008 |
| WO | WO 2008/071325 | | 6/2008 |
| WO | WO 2009/000527 | | 12/2008 |
| WO | WO 2009/000528 | | 12/2008 |
| WO | WO 2009/000528 | A1 | 12/2008 |
| WO | WO 2009/000529 | | 12/2008 |
| WO | WO 2009/000529 | A2 | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |
| WO | WO 2010/003646 | | 1/2010 |
| WO | WO 2010/028739 | | 3/2010 |
| WO | WO 2011/012281 | | 2/2011 |
| WO | WO 2011/032665 | | 3/2011 |
| WO | WO 2011/032671 | | 3/2011 |

OTHER PUBLICATIONS

Schilling A., Diffractive moiré for optically variable devices, Proc. SPIE 6075:6070V, 2006.

International Search Report, International Application No. PCT/EP2008/010747, 2 pages, Jun. 12, 2009.

International Preliminary Report on Patentability, International Application No. PCT/EP2008/010747, 4 pages, Oct. 14, 2010, English Translation.

Oberflächliche Farbenpracht, Physik Journal 5(12):52-53, 2006 (in German).

Oberflächliche Farbenpracht, Physik Journal 5(12):52-53, 2006, English machine translation—3 pages.

* cited by examiner

SECURITY ELEMENT

CROSS-REFERENCE TO RELATED APPLICATIONS

This application is the U.S. National Stage of International Application No. PCT/EP2008/010747, filed Dec. 17, 2008, which claims the benefit of German Patent Application DE 10 2007 061 979.2, filed Dec. 21, 2007, both of which are hereby incorporated by reference to the extent not inconsistent with the disclosure herewith.

The present invention relates to a security element for security papers, value documents and the like having a feature region that selectively influences incident electromagnetic radiation. The present invention further relates to a method for manufacturing such a security element, as well as a security paper and a data carrier having such a security element.

Holograms, holographic grating images and other hologram-like diffraction patterns have been in use for several years to ensure the authenticity of credit cards, banknotes and other value documents. Today, metalized embossing holograms that preferably consist of sinusoidal surface profiles having grating periods between about 600 nm and 2 μm serve on countless banknotes as a sign of their authenticity.

To further improve the attractiveness and counterfeit security, a number of optically variable effects were developed: as soon as the banknote is moved relative to the viewer and/or to the light source, the hologram drastically changes its appearance. Color changes that manifest themselves in so-called moving, tilt or morph effects are particularly typical. This optical variability and the metallic gloss of the metalized hologram foils ensure that true banknotes clearly differ from counterfeits that were created with the aid of color printers. Comparable optical variability cannot be achieved with commercially available inks. Diffraction gratings, the basic building blocks of such holograms, produce, in principle, a spectral color split.

Despite the high level of development that the holograms used to protect banknotes against counterfeiting have since reached, ever-better counterfeits are reaching the market. The grating periods of at least 600 nm used in the holograms are manufacturable not only with electron beam lithography systems, but also through interferometric direct exposure with the aid of a laser, which significantly reduces the counterfeit security of the holograms. Hologram counterfeits are particularly frequently made with the aid of dot matrix systems, whose operating principle is ultimately likewise based on the interference of laser beams.

Also so-called moiré magnification arrangements have been in use for some time as security features. The fundamental operating principle of such moiré magnification arrangements is described in the article "The moiré magnifier," M. C. Hutley, R. Hunt, R. F. Stevens and P. Savander, Pure Appl. Opt. 3 (1994), pp. 133-142. In short, according to this article, moiré magnification refers to a phenomenon that occurs when a grid composed of image objects is viewed through a lens grid having approximately the same grid dimension. As with every pair of similar grids, a moiré pattern results, each of the moiré strips in this case appearing in the form of a magnified and rotated image of the elements of the image grid.

Due to the small line width of about a micrometer of the letters and symbols used in such moiré magnification arrangements, it was not previously possible to produce colored letters through finely patterned metallic surfaces. Diffraction effects may hardly be considered for the coloring because gratings having the usual periods cannot be accommodated in the lines of which the letters or symbols of the micropattern array consist, or can be accommodated only in special cases.

Furthermore, the lens array used for viewing evens out the angle split of individual spectral colors, such that classical grating diffraction in the first diffraction order is little suited for coloring in moiré magnification arrangements or in the more general modulo magnification arrangements.

Based on that, the object of the present invention is to avoid the disadvantages of the background art and especially to create a security element having an attractive visual appearance and high counterfeit security.

This object is solved by the security element having the features of the main claim. A method for manufacturing such a security element, a security paper and a data carrier are specified in the coordinated claims. Developments of the present invention are the subject of the dependent claims.

According to the present invention, in a generic security element is provided that the feature region includes metallic nanopatterns in which volume or surface plasmons are excited and/or resonance effects are caused by the incident electromagnetic radiation.

Plasmons are collective oscillations of the free electrons relative to the ion cores in metals. An increased absorption of the excitation light occurs at the so-called plasma frequency. Light scattering can occur through recombination of plasmons in radiation, especially if the metal is present in particle form. Surface plasmon polaritons (SPs) are electromagnetic radiation that is bound to metallic interfaces and that propagates along its boundary layer, and in doing so, suffers absorption. The excitation of surface plasmon polaritons occurs via the adaptation of the momentum of the incident light and the surface plasmon polaritons via a dielectric or via the reciprocal grating vector of the periodic patterning of the metal surface.

Further, exceptional intensity changes in the transmission or in the reflection can occur at subwavelength gratings if the incident light leads to resonances in the interstices or in the cavities in the grating pattern. Also such resonance effects can be explained by the excitation of surface plasmons or surface polaritons by the incident radiation. Here, in transmission gratings, one can observe a strong intensity shift between reflection and transmission for certain wavelength ranges. These so-called cavity resonances likewise lead to an increased absorption of the light. It is worth mentioning that this effect can also induce an exceptional transmission increase.

Even if the cited physical effects are currently considered to be the correct description of the occurring phenomena, the present invention is defined by the spatial-physical embodiment of the proposed security elements and is not bound to the given explanation of the phenomena due to excitation of volume or surface plasmons or the occurrence of resonance effects.

In the context of the present invention, it is preferred when the feature region of the security element selectively influences incident electromagnetic radiation in the visible spectral range. In particular, the feature region can selectively reflect and/or transmit incident electromagnetic radiation. For example, the feature region can reflect certain spectral portions of visible light and transmit other spectral portions of visible light and, in this way, appear having different colors in reflection and transmission.

To develop a see-through security element, the feature region can especially be developed to be transparent or translucent. In security elements that are designed for viewing in reflection, the feature region or the substrate of the security element can also be opaque.

The feature region can include different metallic nanopatterns in different sub-regions, for example to produce different-colored regions within the security element.

In a preferred variant of the present invention, the feature region exhibits, as metallic nanopatterns, metallic nanoparticles that are embedded in a carrier medium. The metallic nanoparticles advantageously exhibit a largest dimension between 2 nm and 400 nm, preferably between 5 nm and 300 nm, and particularly preferably between 10 nm and 200 nm.

The metallic nanoparticles can be developed to be substantially spherical, but they can also be developed having a preferred direction, especially as rotation ellipsoids or in the shape of rods or platelets.

In an advantageous embodiment, the metallic nanoparticles are formed from homogeneous metallic particles, especially from Au, Ag, Cu or Al particles, since with these, the described color effects are observable in the visible spectral range. In addition, also other metals may be considered, such as Ni, Cr, Wo, Vd, Pd and Pt, as well as alloys of one or more of the cited metals. Alternatively, the metallic nanoparticles can be formed from core-shell particles in which one of the materials of the core and shell is a metal, especially Au, Ag, Cu, Al, another of the above-mentioned metals, or a metal alloy. The other of the materials of the core and shell is advantageously likewise a metal or a dielectric.

To be able, after the application, to arrange or align the nanoparticles through a magnetic field, it can be provided that one of the materials of the core and shell is magnetic. The feature region can further include a mixture of different metallic nanoparticles, especially a mixture of nanoparticles of different diameters.

In the context of the present invention, the carrier medium is preferably formed by a transparent or colored lacquer layer.

In one development of the present invention, the feature region exhibits a patterned surface having elevations and depressions, the metallic nanoparticles being arranged in the depressions of the patterned surface. The patterned surface can especially be formed by a thermoplastically embossable material or an embossed lacquer layer, especially an embossed UV lacquer layer. In some embodiments, the patterned surface is expediently metalized.

To combine the color effects of the nanoparticles with diffraction effects, the patterned surface can form a diffraction pattern that splits the incident electromagnetic radiation spectrally.

Depending on the desired color effect, the patterned surface can be developed to be periodic or also stochastic in one or two spatial directions.

The feature region can further include a metal layer over which the metallic nanopatterns are arranged. In one development of the present invention, the feature region includes a thin-film element that has a color-shift effect and exhibits a metal layer, an absorber layer and a dielectric spacing layer arranged between the reflection layer and the absorber layer, the metallic nanoparticles being arranged in the dielectric spacing layer. The metal layer can be developed to be reflective or, in the event that the security element is to be looked through, also semitransparent.

According to a further, likewise advantageous variant of the present invention, the feature region includes, as metallic nanopatterns, one or more subwavelength gratings having grating periods below the wavelength of visible light. The subwavelength gratings can be developed, for example, as binary patterns that include exclusively planar metallic areal sections on only two different height levels, or as multilevel patterns that include exclusively planar metallic areal sections on n different height levels, where n is between 3 and 16. In a preferred embodiment, the subwavelength gratings exhibit a z-shaped metal profile.

Also the subwavelength gratings can be combined with a diffraction pattern that splits the incident electromagnetic radiation spectrally. To spectrally broaden the resonances that occur, the subwavelength gratings can exhibit grating lines of a varying width.

In an advantageous development of the present invention, laterally different color impressions are produced through subwavelength gratings that exhibit a lateral variation in the grating profiles, especially a lateral variation in the profile depths. In this way, arbitrary colored images, for example screened color images that consist of a plurality of small and different colored pixel elements, can be introduced into the security elements.

In an advantageous embodiment, the security element includes, composed of a plurality of pixel elements, a colored image, the grating profiles being, in each case, constant within a pixel element, and in which the grating profiles of different colored pixel elements are differently developed in accordance with the color impression desired in each case. Alternatively, the color impression of a pixel element can also be produced through color mixing of sub-regions having different grating profiles. For example, three different types of sub-regions can be provided for the colors red, green and blue, and the color impression of each pixel element determined by the choice of the area percentages of the three sub-regions in accordance with the desired RGB value of the pixel.

The color image production through subwavelength gratings is suitable especially for obliquely metallically vapor-deposited dielectric gratings that display different colors in transmission and reflection, as explained below in greater detail. Here, due to the asymmetrical grating profile, an asymmetry of the color appearance is normally also observed at the viewing angle in transmission or in reflection. The lateral variation in the grating profile can especially consist in a lateral variation of the trench depth of the metalized dielectric grating. In addition to binary patterns, also obliquely vapor-deposited asymmetrical multilevel profiles having laterally different depths may be considered.

To produce subwavelength gratings having different profile depths, the following approach, for example, can be used: First, photoresist is applied to a grating substrate having a laterally constant trench depth, such that the trenches are completely filled. Then the substrate having the applied photoresist is impinged on with laser radiation of laterally differing intensities and the trenches partially exposed through removal of the exposed photoresist.

For the color production, as the underlying physical effect, especially polarization conversion through resonance excitation at gratings may be considered, which leads to a selective transmission or reflection when a subwavelength grating is arranged between two crossed polarizers.

The grating periods of the subwavelength gratings are preferably between 10 nm and 500 nm, preferably between 50 nm and 400 nm, and particularly preferably between 100 nm and 350 nm.

The subwavelength gratings can be formed by linear, one-dimensional gratings or also by two-dimensional cross-line gratings that are periodic in one or two spatial directions. In a further variant, the subwavelength gratings are formed by repeated one- or two-dimensional arrangement of metallic pattern elements, the pattern elements especially being formed in the shape of squares, rectangles, circular areas, ring patterns, strips or a combination of these elements or another arbitrary shape. As further shapes, especially spheres, rhombuses or rods, but also strongly asymmetrical shapes, such as open rings, may be considered. All cited arrangements can be periodic in one or two spatial directions.

In addition to one- or two-dimensional linear gratings, according to the present invention, also one- or two-dimensional curved gratings can be provided. In these curved gratings, the azimuth angle of the grating lines changes continually without abrupt jumps. Here, the azimuth angle indicates the local angle between the grating lines (more precisely a tangent to the grating lines) and a reference direction, so describes the local orientation of the grating lines in the plane.

The subwavelength gratings can be integrated in an interference layer system in order to modify or amplify their optical effect.

In all variants of the present invention, the feature region can be present in the form of patterns, characters or a code.

Due to the smallness of the metallic nanopatterns, these can particularly advantageously be used in security elements whose feature regions include micropatterns having a line width between about 1 μm and about 10 μm. Micro-optical moiré magnification arrangements, as are described in publications DE 10 2005 062 132 A1 and WO 2007/076952 A2, moiré-type micro-optical magnification arrangements, as are described in applications DE 10 2007 029 203.3 and PCT/EP2008/005173, and modulo magnification arrangements, as are described in application PCT/EP2008/005172, constitute examples of such security elements. All these micro-optical magnification arrangements include a motif image, having micropatterns, that reconstructs a specified target image when viewed with a suitably coordinated viewing grid. Here, as explained in greater detail in the above-mentioned publications and applications, it is possible to produce a plurality of visually attractive magnification and movement effects that lead to a high recognition value and a high counterfeit security of the security elements produced.

In an advantageous development of the present invention, for this, the micropatterns form a motif image that is subdivided into a plurality of cells, in each of which are arranged depicted regions of a specified target image. The lateral dimensions of the depicted regions are preferably between about 5 μm and about 50 μm, especially between about 10 μm and about 35 μm. In the first micro-optical moiré magnification arrangements mentioned above, the depicted regions of the cells of the motif image each constitute scaled-down images of the specified target image that fit completely within a cell. In the moiré-type micro-optical magnification arrangements, the depicted regions of multiple spaced-apart cells of the motif image constitute in each case, taken together, a scaled-down likeness of the target image, whose dimension is larger than one cell of the motif image. In the most general case, the magnification arrangement constitutes a modulo magnification arrangement in which the depicted regions of the cells of the motif image each constitute incomplete sections of the specified target image that are mapped by a modulo operation.

The security element preferably further exhibits a viewing grid composed of a plurality of viewing grid elements for reconstructing the specified target image when the motif image is viewed with the aid of the viewing grid. Here, the lateral dimensions of the viewing grid elements are advantageously between about 5 μm and about 50 μm, especially between about 10 μm and about 35 μm.

In the special case of a micro-optical moiré magnification arrangement, a motif image composed of a planar periodic or at least locally periodic arrangement of a plurality of micromotif elements is preferably applied as the micropattern. Here, the lateral dimensions of the micromotif elements are advantageously between about 5 μm and about 50 μm, preferably between about 10 μm and about 35 μm. In addition, the opposing side of the substrate is expediently provided with a planar periodic or at least locally periodic arrangement of a plurality of microfocusing elements for the moiré-magnified viewing of the micromotif elements of the motif image. In some embodiments, it is appropriate to arrange the microfocusing elements and the micromotif elements on the same side of the substrate. Also two-sided embodiments in which a micromotif element arrangement can be viewed through two opposing microfocusing element arrangements may be considered.

The present invention also includes a method for manufacturing a security element of the kind described, in which, in a feature region, the security element is provided with metallic nanopatterns in which volume or surface plasmons are excited and/or resonance effects are caused by the incident electromagnetic radiation.

Here, in an advantageous method variant, as metallic nanopatterns, metallic nanoparticles embedded in a carrier medium are applied to, especially imprinted on, a substrate.

If the metallic nanoparticles are magnetic, then they can be aligned and/or arranged by an external magnetic field after the application to the substrate. The nanoparticles are expediently immobilized after the alignment and/or arrangement by drying or curing the carrier medium.

In an advantageous development, the substrate is provided with a patterned surface having elevations and depressions, and metallic nanoparticles are introduced into the depressions of the patterned surface. For this, advantageously, a fluid carrier medium having the metallic nanoparticles can be applied to, for example imprinted on, the patterned surface, and the patterned surface then squeegeed or wiped such that the metallic nanoparticles are left only in the depressions of the patterned surface. Thereafter, the patterned surface having the nanoparticles introduced into the depressions is advantageously covered with a lacquer layer.

In another likewise advantageous method variant, as metallic nanopatterns, one or more subwavelength gratings having grating periods below the wavelength of visible light are applied to a substrate. For this, a relief pattern, for example, can be embossed in an embossing lacquer layer in the form of the desired subwavelength gratings, and a metalization applied to, especially vapor-deposited on, this relief pattern. The metalization is expediently deposited at a deposition angle Q that is between 0° and 90°, preferably between 30° and 80°. The metalized relief pattern is then advantageously covered with a further lacquer layer.

As the subwavelength gratings, also a repeated one- or two-dimensional arrangement of metallic pattern elements can be applied to, especially vapor-deposited on, the substrate, as described in greater detail below.

In a further advantageous manufacturing process, the nanopatterns are produced through laser irradiation of a thin metal layer. Here, the metal layer can be arranged on patterned or unpatterned regions of a substrate and either lie free or be embedded. The metal layer can be both contiguous and be contiguously bombarded with a laser, and be developed only in some regions, such that the laser irradiation leads to the formation of nanopatterns only in the metalized and illuminated regions. In a further embodiment, a contiguous metal layer can be vertically or obliquely illuminated with laser radiation, for example the radiation of a focused laser, only at predetermined sites such that nanopatterns are created only at the illuminated sites.

The present invention further includes a security paper for manufacturing value documents or the like, as well as a data carrier, especially a value document, such as a banknote, a passport, a certificate, an identification card or the like. According to the present invention, the security paper or the data carrier is furnished with a security element of the kind described. The security element can, especially if it is present on a transparent or translucent substrate, also be arranged in or over a window region or a through opening in the security paper or the data carrier.

Further exemplary embodiments and advantages of the present invention are described below with reference to the drawings. To improve clarity, a depiction to scale and proportion is dispensed with in the drawings.

Figure 2:
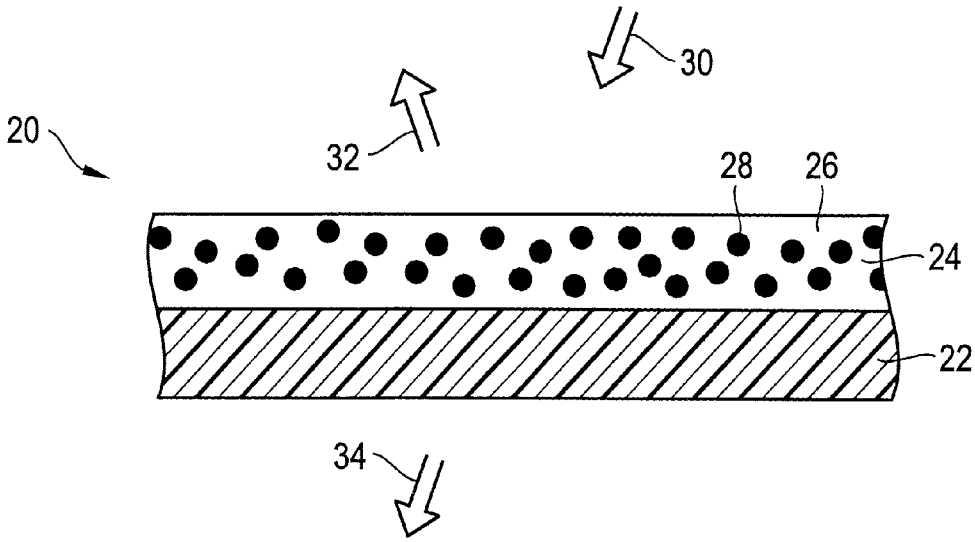
Figure 3:
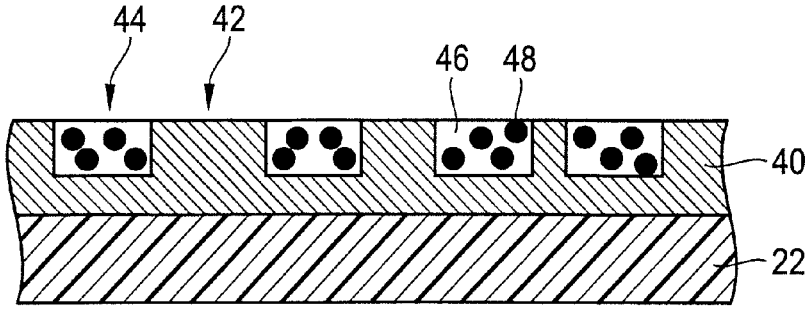
Figure 4:
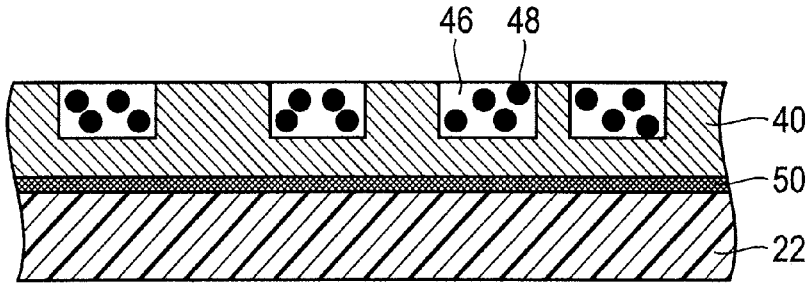
Figure 5:
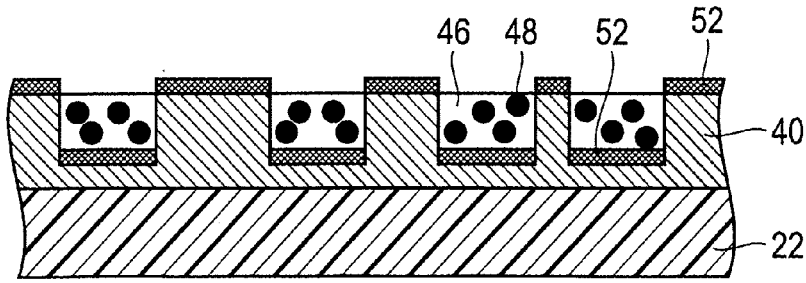
Figure 6A:
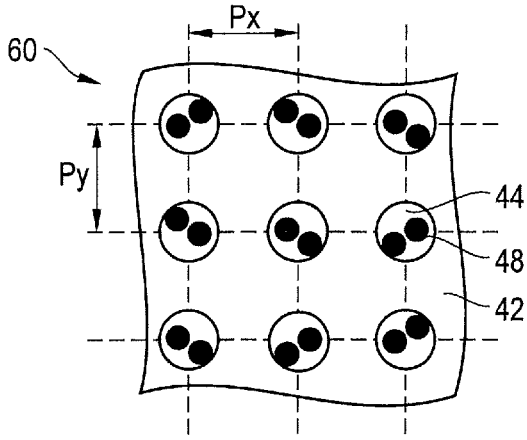
Figure 6B:
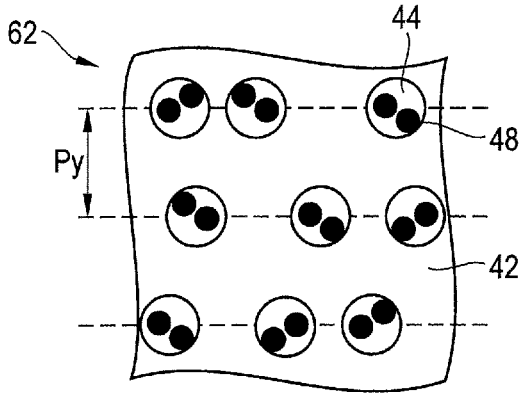
Figure 6C:
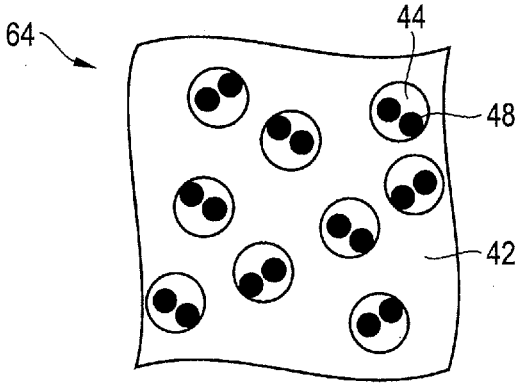
Figure 7:
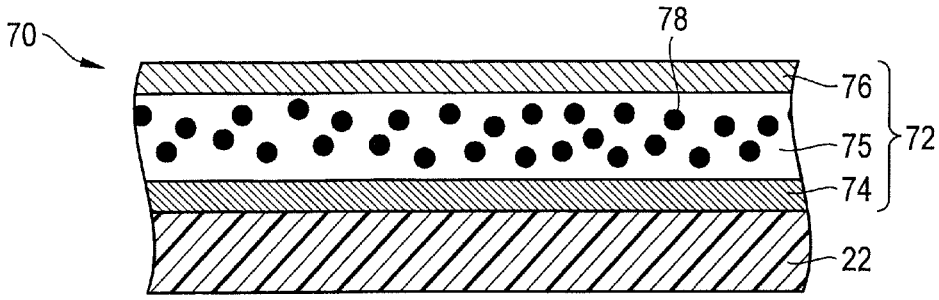
Figure 8:
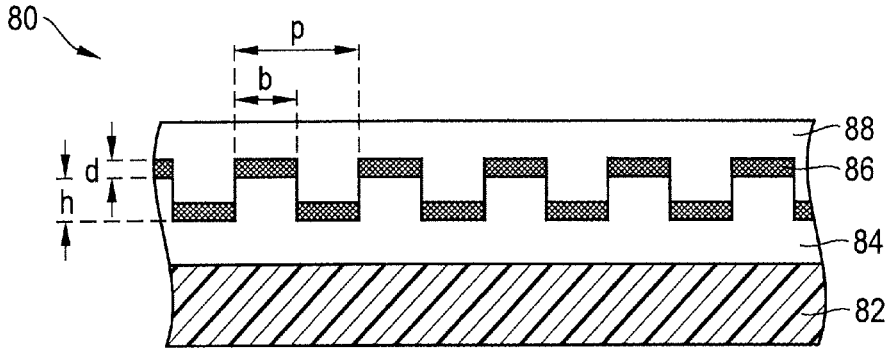
Figure 9:
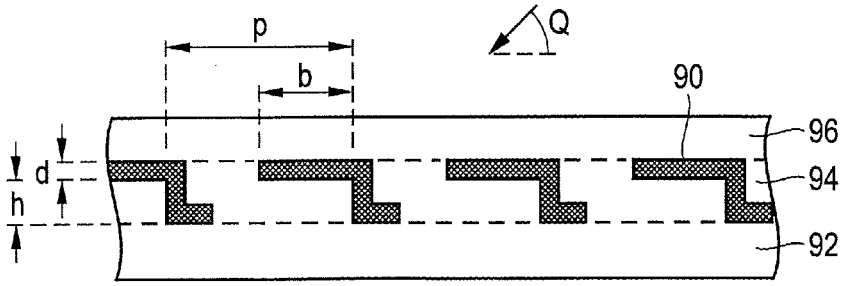
Figure 10A:
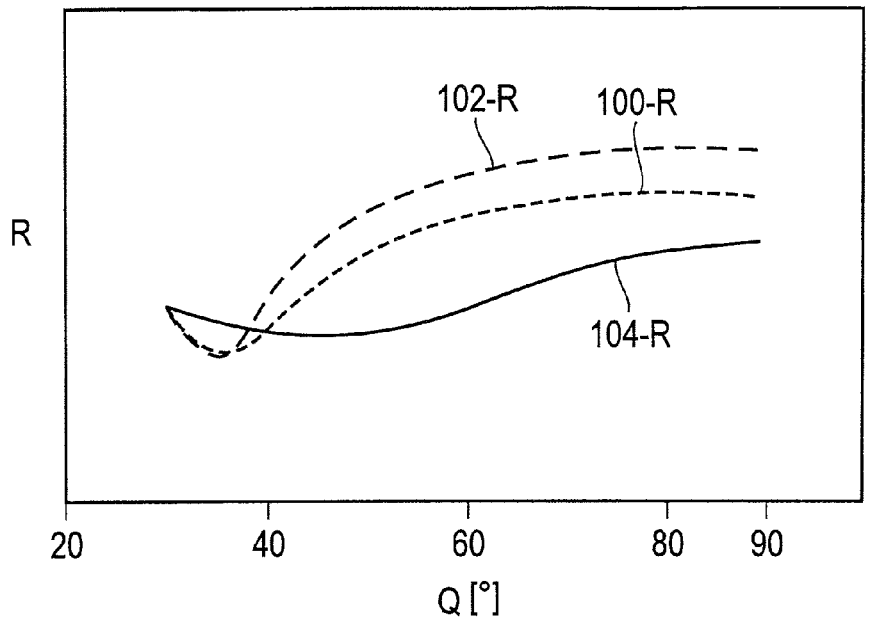
Figure 10B:
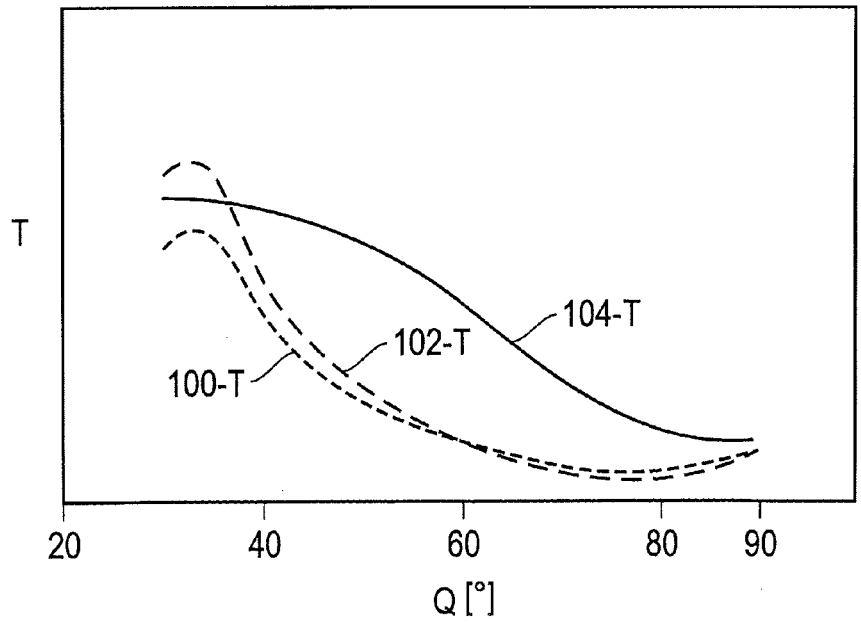
Figure 11:
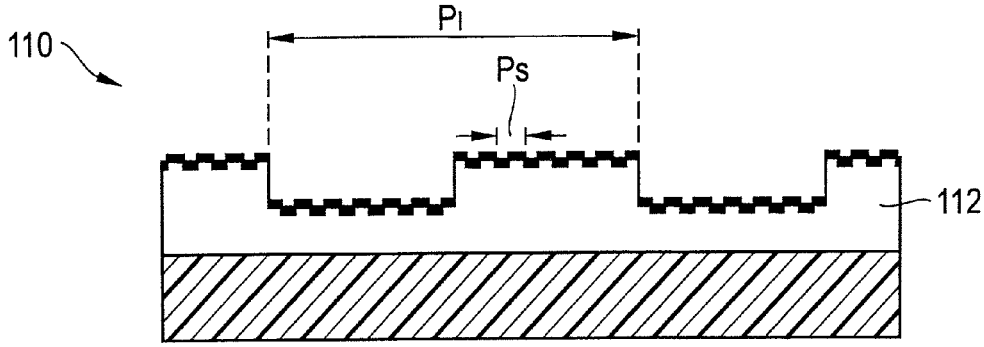
Figure 12:
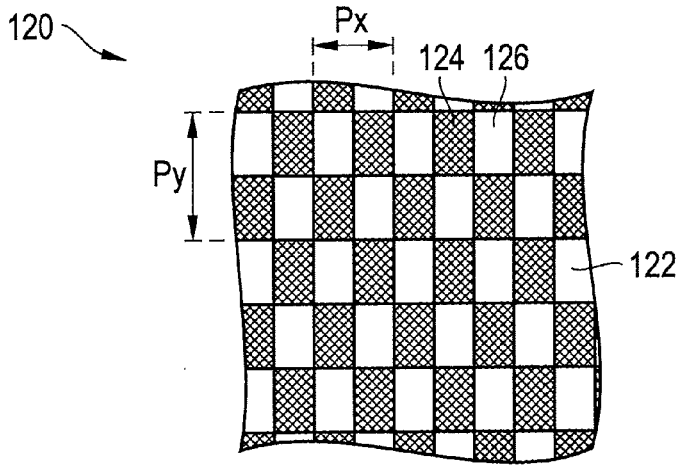
Figure 13A:
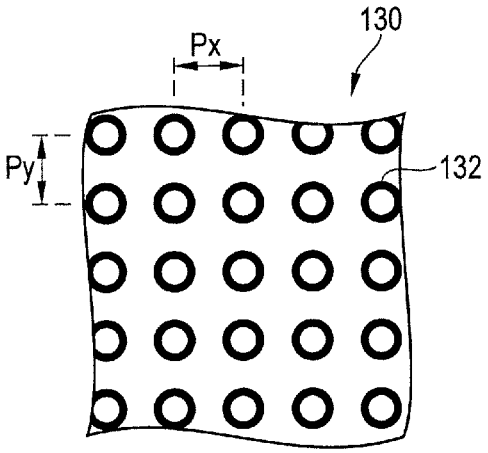
Figure 13B:
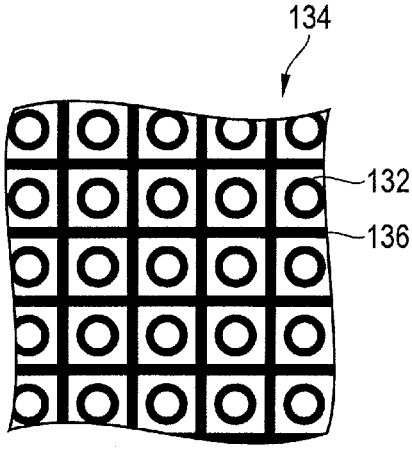
Figure 14:
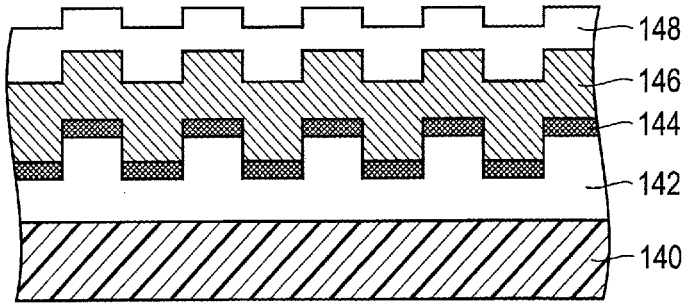
Figure 15A:
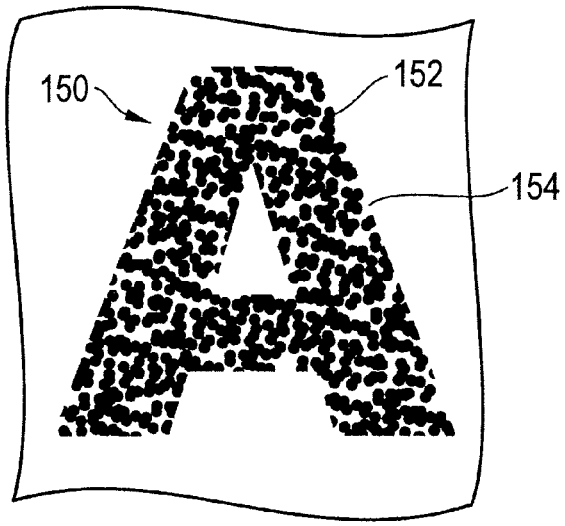
Figure 15B:
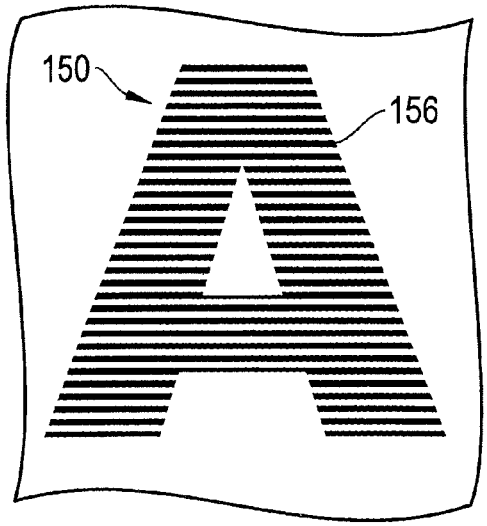
Figure 15C:
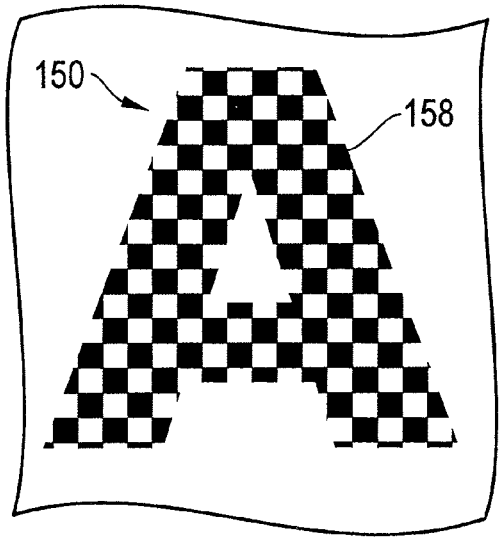
Figure 16:
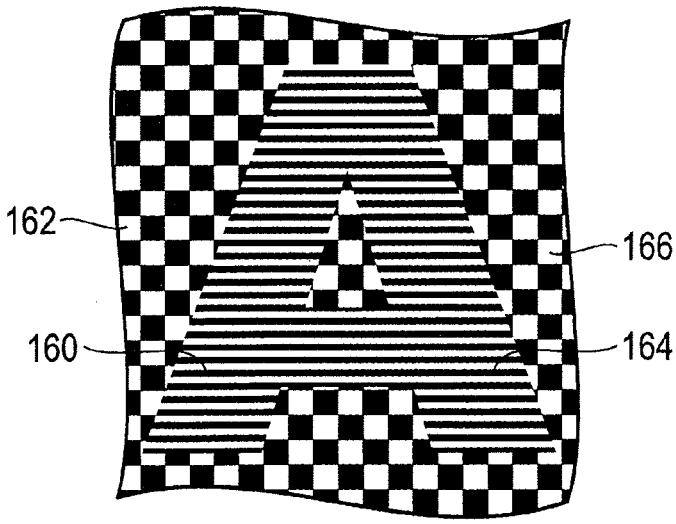

Shown are:

FIG. 1 a schematic diagram of a banknote having a see-through security element and an affixed transfer element, each according to exemplary embodiments of the present invention, FIG. 2 a see-through security element according to the present invention, in cross-section, FIGS. 3 to 5 exemplary embodiments having patterned surfaces for controlling the spatial distribution of the metallic nanoparticles, FIG. 6 in (a) to (c), views of the feature regions of further security elements according to the present invention, FIG. 7 an exemplary embodiment in which metallic nanoparticles are integrated into a thin-film element having a color-shift effect, FIGS. 8 and 9 schematic cross sections through inventive security elements having subwavelength gratings, FIG. 10 highly schematically, the coloring of certain inventive subwavelength gratings according to the present invention, as a function of the deposition angle Q, with (a) showing the coloring in reflection and (b) the coloring in transmission, in each case in the zeroth diffraction order, FIG. 11 a security element according to the present invention whose feature region is provided with a metalized embossing pattern having two overlapping gratings, FIG. 12 a schematic top view of a feature region having a rectangular cross-line grating that is periodic in two spatial directions, FIG. 13 in (a) and (b), top views of subwavelength gratings that are formed from two-dimensional periodic arrangements of pattern elements, FIG. 14 a subwavelength grating integrated in an interference layer system, FIG. 15 in (a) to (c), three embodiments of micromotif elements that appear colored through filling with metallic nanopatterns, and FIG. 16 an exemplary embodiment as shown in FIG. 15, in which both the micromotif elements and the surrounding vellum region are nanopatterned.

The invention will now be explained using the example of security elements for banknotes. For this, FIG. 1 shows a schematic diagram of a banknote 10 that is provided with two security elements 12 and 16 according to exemplary embodiments of the present invention. Here, the first security element constitutes a see-through security element 12 that is arranged over a see-through region 14, such as a window region or a through opening in the banknote 10. The second security element 16 is formed by an opaque, affixed transfer element of arbitrary shape.

Both security elements exhibit, in a feature region, metallic nanopatterns in which, by incident visible light, volume or surface plasmons are excited or resonance effects are caused that produce novel color effects that, due to the smallness of the coloring nanopatterns in each case, are very difficult to counterfeit.

As already explained above, plasmons constitute the eigenmodes of collective oscillations of the free electrons relative to the ion cores in metals, which eigenmodes can be excited by incident electromagnetic radiation. At a certain wavelength, the freely movable charge carriers are excited to resonant oscillations, such that the light of this wavelength is preferably absorbed and scattered in all spatial directions. Radiation having wavelengths outside of the resonance range, in contrast, can pass largely undisturbed.

Due to this effect, the metallic nanopatterns according to the present invention appear, when looked through, having a color impression that results from the wavelengths of the uninfluenced, non-resonant portion of the incident light. When viewed in reflection, in which the scattered light dominates the visual appearance, the color impression of the nanopatterns is determined, in contrast, mainly by the resonant portion of the spectrum. Which wavelengths can excite the resonant plasma oscillations depends, in addition to the material of which the nanopatterns consist, also on the shape and size of the nanopatterns and the embedding medium.

The exemplary embodiment in FIG. 2 first shows a see-through security element 20 having a substrate 22 and a feature region that is formed by a contiguously applied feature layer 24. The feature layer 24 includes a plurality of metallic nanoparticles 28 that are embedded in a carrier medium 26. Such a feature layer 24 can be produced, for example, by imprinting a transparent lacquer 26 in which prefabricated metallic nanoparticles 28 having desired properties are dissolved.

The nanoparticles 28 exhibit a diameter below the wavelength of visible light, preferably between 300 nm and 5 nm and especially between 200 nm and 10 nm. In a preferred variant of the present invention, the nanoparticles 28 are gold or silver particles. However, also other metals, such as copper, aluminum, nickel, chrome, tungsten, vanadium, palladium, platinum or alloys of these metals, display, even if to some extent in attenuated or modified form, color effects due to plasmon excitation, so that also these metals or metal alloys may be considered as material for the nanoparticles 28.

In addition to spherical nanoparticles 28, also differently formed particles, such as rotation ellipsoids, arbitrary polyhedra or also rod- or platelet-shaped particles can be used. Particles that deviate from the spherical shape additionally display, when they are oriented toward a preferred direction in space, effects that are dependent on the polarization direction of the incident light.

In addition to homogeneous metallic nanoparticles 28, also coated core-shell particles may be considered for the color production. These can exhibit both a metallic core having a dielectric or metallic shell and a dielectric core having a metallic casing. Silver particles having a $TiO_2$ shell and polystyrene cores having a gold coating are examples of such embodiments. The number of combination possibilities here is almost unlimited, particularly since, in addition to the amorphous phase, the materials can also be present in crystalline or polycrystalline form.

In the simplest case, the transparent lacquer 26 in which the nanoparticles 28 are dissolved is contiguously applied to, for example imprinted on, the substrate 22, as shown in FIG. 2. Broadband incident light 30 then excites in the nanoparticles 28, depending on the material, shape and size of the particles 28 and their embedding medium 26, certain plasma oscillations (plasmons). For example, the resonance frequency for substantially spherical gold particles having a diameter of 50 nm is about 520 nm, for gold particles having a diameter of 150 nm, about 580 nm.

In the exemplary embodiment in FIG. 2, the nanoparticles 28 and the embedding medium 26 are coordinated with one another in such a way that the resonance frequency of the embedded nanoparticles 28 is a wavelength of about 530 nm in green.

When viewed in reflection 32, where the light scattered by the nanoparticles 28 dominates the color impression, the feature layer 24 thus appears green. In transmission 34, in contrast, the feature layer 24 appears in the subtractive complementary color, so having a red color impression.

Unlike with periodic diffraction patterns or interference layer systems, the color impression of the metallic nanoparticles is not dependent on the angle of incidence of the radiation and the viewing direction. Upon tilting, the security elements according to the present invention also do not run through the visible spectrum or sections thereof, but rather exhibit a substantially constant color impression. Since the color effects are caused by nanopatterns that are substantially smaller than the period of conventional diffraction gratings, they exhibit a particularly high counterfeit security, since such small patterns can hardly be manufactured with conventional methods, such as direct exposure or dot matrix methods.

Instead of being developed to be contiguous, the feature region of the security element 20 can also be designed in the form of patterns, characters or a code. It is also possible to provide, in different sub-regions of the feature region, different metallic nanopatterns, for example nanoparticles 28 composed of different materials and/or nanoparticles 28 of different shapes and sizes. In this way, different regions of the feature region can be colored differently.

Furthermore, the lacquer 26 provided with the coloring nanoparticles 28 can additionally include conventional color or effect pigments in order to modify the observable color effects. Also different kinds of metallic nanoparticles 28, for example having varying diameters, can be mixed with one another in order to produce a desired color effect in coaction.

In a further embodiment, measures can be taken to influence the spatial distribution of nanoparticles 28 that are initially dispersed homogeneously in a carrier medium, or the preferred direction non-spherical nanoparticles. This can happen, for example, in that the nanoparticles are furnished with a magnetic core, such that they can be concentrated at the intended locations of the feature region with the aid of spatially varying magnetic fields. Here, the nanoparticles 28 are initially still movable in the carrier medium 26. Only after they were positioned and/or aligned with the aid of the magnetic fields are they immobilized in that the binder of the carrier medium 26 is cured, for example by drying or irradiation with UV light, or the carrier medium 26 or at least the solvent included therein is evaporated by the addition of heat.

Functionalized surfaces of nanoparticles offer additional possibilities to influence the arrangement of the nanoparticles. For example, through a suitable functionalization of the surface, it can be achieved that the particles arrange themselves at a certain spacing and/or in a defined grating. Furthermore, a clustering of the nanoparticles can be prevented through a suitably chosen functionalization.

Also a functionalization of the substrate surface can serve the arrangement and periodic alignment of the nanoparticles. Through a functionalization of the substrate surface and, if applicable, also the surface of the nanoparticles, said nanoparticles can be systematically deposited on predefined regions of the substrate. In this way, it is possible, for example, to arrange the nanoparticles on grating lines in order to influence, for example to intensify, the diffraction property of the grating.

Alternatively, also nanoparticles 28 that are unmagnetic per se can be coupled through functional coatings to magnetic carrier particles that then, together with the coloring nanoparticles 28 are systematically arranged and/or aligned by external magnetic fields.

According to a preferred variant of the present invention, the distribution of the nanoparticles 28 is systematically influenced by a patterning of the surface to which they are applied. For example, as shown in the exemplary embodiment in FIG. 3, a transparent UV curing lacquer layer 40 can be provided with a desired relief embossing such that a patterned surface having elevations 42 and depressions 44 is created. A fluid medium 46 in which the nanoparticles 48 are dissolved is then applied to, for example imprinted on, the surface patterned in this way. Thereafter, the fluid medium 46 is squeegeed or wiped from the coated surface such that the nanoparticles 48 are left only in the depressions 44, but not on the raised surface regions 42.

In order to prevent the nanoparticles 48 from falling out of the depressions 44 during the further processing, the structure can be covered with a further lacquer layer that is not depicted in the figures. If the lacquer used for covering flows around the nanoparticles 48, then also the refractive index of the medium embedding the particles can be defined in this way. However, it is currently preferred that the nanoparticles 48 remain embedded in the original carrier medium 46 that, together with the nanoparticles 48, remains in the depressions 44 when the surface is squeegeed.

In the exemplary embodiment shown in FIG. 4, a metal layer 50 is additionally provided between the substrate 22 and the UV lacquer layer 40 in order to systematically modify the color impression of the nanoparticles 48. Alternatively, as shown in FIG. 5, a metal layer 52 can also be applied to, for example vapor-deposited on, the embossed UV lacquer layer 40 prior to the application of the nanoparticles 48, and in this way, the color impression of the nanoparticles 48 modified.

According to an advantageous manufacturing variant, also the micro intaglio printing technique described in international patent application PCT/EP2007/005200 can be used, which combines the advantages of printing and embossing technologies. Summarized briefly, in the micro intaglio printing technique, a die form is provided whose surface exhibits an arrangement of elevations and depressions in the form of a desired micropattern. The depressions in the form are filled with a curable colored or colorless lacquer that contains the nanoparticles, and the substrate to be printed on is pretreated for a good anchoring of the lacquer. Then the surface of the die form is brought into contact with the substrate, and the lacquer that, in the depressions in the die form, is in contact with the substrate is cured and, in the process, joined with the substrate. Thereafter, the surface of the die form is removed from the support again such that the cured lacquer that is joined with the support and having the nanoparticles is pulled out of the depressions in the die form. For a more detailed description of the micro intaglio method and the associated advantages, reference is made to the cited patent application PCT/EP2007/005200, the disclosure of which is incorporated in the present application by reference.

In the security elements described above, the visual impression can not only be produced by the effects of the plasmon excitation in the nanoparticles 48, but can also be influenced by diffraction effects on the patterns that are specified by the elevations 42 and depressions 44. In the case of periodically arranged linear trenches, in addition to the described plasmon effects, for example, a spectral splitting of the light that is typical for diffraction on a linear grating can appear. These diffraction effects can be systematically integrated in the design of the security element. If such additional, strongly color-producing effects are undesired in other embodiments, then the elevations and depressions 42, 44 can also be arranged irregularly and diffraction-based color appearances largely suppressed.

For illustration, FIG. 6(*a*) shows a top view of the feature region 60 of a security element according to the present invention, in which the depressions 44 having the nanoparticles 48 are arranged periodically in two spatial directions. It is understood that the period lengths denoted with px and py can be identical or different, such that identical or different diffraction color effects occur in the x-direction and the y-direction.

In the top view of the feature region 62 in FIG. 6(*b*), the depressions 44 having the nanoparticles 48 are arranged periodically only in the y-direction, while they are distributed randomly in the x-direction. In such an embodiment, diffraction effects due to the periodic arrangement of the depressions 44 occur only in the y-direction, while they are suppressed in the x-direction. If the color-splitting diffraction effects are entirely suppressed, the depressions 44 can also be arranged randomly in both spatial directions, as shown in the feature region 64 in FIG. 6(*c*).

FIG. 7 shows an exemplary embodiment 70 of a further variant of the present invention, in which the nanoparticles 78 are integrated in a thin-film element 72 having a color-shift effect. For this, on a substrate 22 are applied a reflective metal layer 74, for example an aluminum layer having a thickness of at least 10 nm, a dielectric intermediate layer 75 composed of a UV-curing material, and a semitransparent absorber layer 76 that can be formed, for example, by an about 8 nm thick chrome layer. The dielectric intermediate layer 75 is preferably formed from a carrier medium having a high refractive index. It also includes the desired metallic nanoparticles 78, which can be achieved, for example, in that the nanoparticles 78 are added to the intermediate layer material prior to application. Altogether, in the security element 70 that is designed for viewing in reflection, the filter effect of the nanoparticles 78 is combined with the color filter effect of the color-shifting thin-film system 72.

In some embodiments, the semitransparent absorber layer 76 can also be dispensed with. If the security element 70 is to be used in transmission, so for example in the see-through window of a banknote, then the lower metal layer 74 is expediently designed to be semitransparent.

It is understood that, also in the exemplary embodiments in FIGS. 3 to 7, the feature region can be developed in the form of patterns, characters or a code, and that also here, different metallic nanopatterns can be provided in different sub-regions. Both transparent and non-transparent layer systems may be considered as the substrate 22. In particular, the substrate 22 can be formed, for example, by a transparent or opaque plastic foil that remains in the finished security element or by a transfer foil that is removed after the security element is transferred to the banknote 10. The substrate 22 can also be formed by the banknote paper itself. For this, the nanoparticles can, for example, be suspended in a primer prior to printing and printed directly on the banknote paper.

The manufacture of the metallic nanoparticles themselves can occur through physical or chemical methods known to the person of skill in the art. Laser ablation is an example of a physical method.

Instead of resorting to prefabricated nanoparticles that are dissolved in suitable media and applied to a desired substrate through, for example, printing, according to a further aspect of the present invention, also one or more subwavelength gratings can be applied directly to the substrate of the security element. On the one hand, such periodic nanopatterns permit more intense color effects than the previously described metallic nanoparticles, and on the other hand, the multitude of degrees of freedom at manufacture further increases the counterfeit security of such security elements.

In subwavelength gratings, exceptional intensity changes can occur in the transmission or in the reflection if the incident light leads to resonances in the interstices or in the cavities in the grating pattern. Here, in transmission gratings, one can observe a strong intensity shift between reflection and transmission for certain wavelength ranges. These so-called cavity resonances likewise lead to an increased absorption of the light. It is worth mentioning that this effect can also induce an exceptional transmission increase.

Also the so-called Wood's anomalies influence, independently of the polarization of the incident light, the transmission or reflection spectra of gratings in the zeroth diffraction order. A Wood's anomaly is associated with the creation of a new diffraction order, that is, it occurs when the angle of reflection is 90°. The spectral positions of the Wood's anomalies can thus be derived from the grating equation. They result for wavelengths $\lambda=(p/m)\ (1\pm\sin\alpha)$, where p represents the grating period, $\alpha$ the angle of incidence and m the diffraction order. When a diffraction order disappears, its intensity must be redistributed to the remaining diffraction orders, which also leads to a spectral intensity change in the zeroth diffraction order. Finally, an increase in the transmission, with an attendant reduction in the reflection, was observed in wire gratings for wavelengths of the Wood's anomalies under TE polarization (e-vector parallel to the grating pattern). For increasingly larger wavelengths, the transmission is reduced and finally, in the limiting case, approaches zero.

For illustration, first, patterns are described that exhibit a periodicity only in one dimension. FIG. 8 shows a cross section through a security element 80 having a transparent substrate foil 82, on which a UV embossing lacquer layer 84 is imprinted and embossed in the form of a rectangular profile that exhibits a period length p, for example 300 nm, a bridge width b, for example 100 nm, and a pitch h, for example 100 nm. An aluminum layer 86 of a thickness d, for example 30 nm, was then vertically vapor-deposited on the embossing lacquer layer 84 and the resulting structure provided with a further protective lacquer layer 88.

In this way, a metallic binary pattern 86 that is embedded in the lacquer layers 84, 88 and that includes exclusively planar metallic areal sections on only two different height levels (metallic bi-grating) results. The metallic areal sections can also be arranged on more than two height levels, especially on n=3 to n=16 different height levels, and in this way form a more general multilevel pattern.

If the deposition angle Q of the metal layer 90 deviates from 90°, a subwavelength grating having a z-shaped metal profile is created, as illustrated in FIG. 9 for the case Q=45°. Here, in the simplified depiction in FIG. 9, it is assumed that the width of the metal application in the lower plane is specified by the geometric shadowing upon vapor deposition, and that the thickness d of the metal film 90 is identical on the upper and lower plane. In the general case, the regions 92, 94 and 96 below, within and above the z-shaped metal profile can exhibit different refractive indices $n_1$, $n_2$ or $n_3$. However, if standard UV lacquer is used for the embossed lacquer layer and the protective lacquer layer, these values are normally all n=1.5.

The transmission or reflection spectra of such subwavelength gratings can be calculated, for example, with the aid of electromagnetic diffraction theories. To be able to estimate the perceived coloring of these gratings, the spectrum calculated for the visible wavelength range is folded with the spectrum of the standard lamp D65 and the sensitivity curves of the human eye. This yields the parameters X, Y and Z that reflect the color values red, green and blue.

FIG. 10 shows, highly schematized, the coloring of inventive subwavelength gratings having a grating period p=300 nm, a bridge width b=100 nm, a pitch h=100 nm, a thickness d=30 nm of the vapor-deposited aluminum layer, and identical refractive indices of the surrounding dielectrics $n_1=n_2=n_3=1.5$ for vertical incidence of unpolarized light. In FIG. 10(*a*), the color values X (curve 100-R), Y (curve 102-R) and Z (curve 104-R) of the reflected light in the zeroth diffraction order are depicted as a function of the deposition angle Q. FIG. 10(*b*) shows the color values X (curve 100-T), Y (curve 102-T) and Z (curve 104-T) of the transmitted light, likewise in the zeroth diffraction order.

The special case of vertical vapor deposition shown in FIG. 8 is given for Q=90°. For an increasingly oblique deposition angle, a z-shaped wire profile develops, with the profile depicted in FIG. 9 resulting for Q=45°. In the process, the degree of covering of the metal film becomes smaller and the transmission of the light increases. If the angle Q is smaller than arctan(h/(p-b)), then metalization of the lower plane no longer takes place.

A strong coloring of a nanopattern results when one of the color values X, Y, Z is dominant with respect to the other color values, or when the color values strongly differ from one another. As can be seen from the curve shapes 100, 102 and 104 in FIG. 10, especially for deposition angles Q in the range between about 45° and about 80°, the color value Z dominates the transmission (FIG. 10(*b*), curve 104-T), while the color values X and Y dominate the reflected radiation (FIG. 10(*a*), curves 100-R, 102-R). Such subwavelength gratings thus appear having a clearly pronounced coloring in transmission and reflection.

For the color perception, it is further desirable that the reflection of an object is at least 20% so that the color spectrum reflected at the object stands out from the reflected light of the surrounding medium. The transmission, in contrast, can be lower for the color perception, since usually only the transmitted light of the object is observed and the scattered light of the surroundings is covered. For the light intensity of the grating described above, a reflection of 30% to 60% and a transmission between 5% and 45% is obtained for a deposition angle Q in the range between 30° and 90°. Here, for more oblique deposition angles, the transmission increases while the reflection decreases.

In addition to the described effects, for the subwavelength gratings according to the present invention, the color effect changes when viewed in polarized light. This also distinguishes the inventive coloring feature regions of colored surfaces that were produced with conventional means. For example, for subwavelength gratings having the above-mentioned grating parameters, especially the intensity of the color value Z (blue) changes with the polarization of the incident light, the differences between TE polarization (e-vector of the incident light parallel to the grating lines) and TM polarization (e-vector of the incident light vertical to the grating lines) being particularly large at a deposition angle in the region of Q=45°.

Here, due to the asymmetric grating profile, also an asymmetry of the color appearance in the viewing angle is observed in transmission or in reflection. Through systematic lateral variation in the grating profiles, especially the profile depths, it is thus possible to produce laterally different color impressions within the security element and thus also color images, as described above in detail.

In further exemplary embodiments of the present invention, the described subwavelength gratings can be combined with a diffraction pattern that spectrally splits incident electromagnetic radiation. For illustration, FIG. 11 shows a security element 110 whose feature region is provided with a metalized embossing pattern 112 having two overlapping gratings. The grating having the smaller grating period $p_s$ forms a subwavelength grating of the kind described above. This subwavelength grating is overlaid with a second grating, of a substantially larger period $p_l$, that serves to produce a multiplication or spectral broadening of the above-described resonances of the subwavelength grating.

If locally varying widths of the metallic grating lines are used, for example a modulation of the grating line width in the form of a beat or a statistical variation in the grating line widths, then the plasmon resonances can be spectrally broadened. In this way, a broader range of the visible light spectrum can be influenced in its intensity than would be the case through a strictly periodic grating.

In generalization of the one-dimensional subwavelength gratings described so far, also two-dimensional cross-line gratings can be used that are arranged periodically or also statistically in one or two spatial directions. FIG. 12 shows a schematic top view of a feature region 120 having a rectangular cross-line grating 122 that is periodic in two spatial directions. The sequence of hatched and non-hatched rectangles 124, 126 constitutes, in each case, higher- or lower-lying metalized areal sections, as shown in cross-section in, for example, FIG. 8.

Due to the rectangular design of the cross-line grating 122, the period lengths in the x-direction and the y-direction, px and py, are, in general, different. For different period lengths px, py, the cross-line grating 122 produces a different color impression in polarized light, depending on whether the light is polarized vertically or horizontally. When viewed with unpolarized light, the viewer perceives a mixed color. If, in contrast, the period lengths px and py are identical, then, when viewed with unpolarized light, the cross-line gratings look just as if one were viewing it with vertically or horizontally polarized light.

The one- or two-dimensional subwavelength gratings can also be formed by a repeated arrangement of metallic pattern elements, with, in addition to quadratic or rectangular elements, especially also circular, elliptical, ring-shaped or arbitrarily formed elements being able to be considered.

FIG. 13 shows, for illustration, in (a), a top view 130 of a subwavelength grating that is formed from a two-dimensional periodic arrangement of ring elements 132. Here, the period lengths px and py are both below the wavelength of visible light and can be, for example, 300 nm. While the case px=py is depicted in FIG. 13(*a*), the period lengths can, of course, also be different. For the excitation of plasmons by incident light, especially the ring width of the ring elements 132 is important.

In the top view 134 in FIG. 13(*b*), two different geometries are combined with one another, namely strip-shaped pattern elements 136 and ring-shaped pattern elements 132. In particular, the strips 136 are excited by the external electromagnetic radiation. They transport the absorbed electromagnetic energy to the ring elements 132 and, to some extent, transfer them to same. Since pattern elements of different geometries normally also exhibit different plasmon resonances, such a combination of different pattern elements can lead to a modified resonance behavior and thus to an altered color impression of the overall system.

In general, the elements of arbitrary shape can be distributed statistically or stochastically on the surface that is to appear colored.

It is understood that the variants described for the one-dimensional subwavelength gratings, especially the use of Wood's anomalies and the combination of the subwavelength gratings with diffraction gratings, can also be used for two-dimensional cross-line gratings and the one- or two-dimensional pattern element arrangements.

The described subwavelength gratings can also be integrated in an interference layer system in order to modify or amplify their optical effect. An exemplary layer system is shown in the cross section in FIG. 14. Here, on a transparent substrate foil 140, a UV embossing lacquer layer 142 is imprinted and embossed in the form of a desired one- or two-dimensional subwavelength grating. An aluminum layer 144 of a desired thickness is then vapor-deposited on the embossing lacquer layer 142 vertically or at a certain deposition angle Q.

Thereafter, a layer 146 having a high refractive index, preferably ZnS or $TiO_2$, is applied, for example likewise through vapor deposition. Whether or how clearly the embossing pattern is still reflected at the surface of this high-index layer 146 depends on the circumstances under which the layer was applied. The most important parameter in this regard is, of course, the layer thickness. The interference layer system is completed by application of a further layer 148 of a transparent material having a lower refractive index, for example protective lacquer with n=1.5. The optical effect of the high-index dielectric layer 146 is substantially determined by its thickness and the difference between the refractive index and the surroundings.

The high resolution required for the described subwavelength gratings may be achieved, for example, with the aid of electron beam lithography systems, with even the smallest particles having a lateral dimension of some 10 nm still being able to be produced having individual contours. Here, PMMA is typically used as the resist. The origination by means of electron beam lithography is followed by galvanic casting and the manufacture of embossing tools with whose aid the nanopatterns can thereafter be replicated by embossing in UV-curing lacquer or a thermoplastically moldable plastic on foil webs. The metallic nanopatterns are obtained in the subsequent step through vapor deposition or sputtering with the corresponding material in the desired layer thickness, taking note that the metal layer thickness should normally be smaller than the embossing depth. Gold, silver, copper and aluminum are preferably used as the metals.

A particular advantage of the metallic nanopatterns according to the present invention consists in that, even in small micropatterns having dimensions of a few micrometers, they can be arranged in a sufficient number of periods or quasiperiods. Typical examples of such micropatterns are letters and symbols that form the micromotif images of a moiré magnification arrangement. The operating principle and advantageous arrangements for such moiré magnification arrangements are described in publications DE 10 2005 062 132 A1 and WO 2007/076952 A2, the disclosure of which is incorporated in the present application by reference.

If such micropatterns are filled with nanopatterns according to the present invention, they can be lent a coloring that is very difficult to achieve, or is simply unachievable, in another manner, especially with multiple colors in a very small space.

FIG. 15 shows, in (a) to (c), by way of example, three embodiments of micromotif elements 150 that appear colored through filling with metallic nanopatterns. The micromotif elements 150 that, for illustration, are depicted in FIG. 15 only by the letter "A", typically exhibit a lateral dimension between 10 μm and 35 μm and a line width between 1 μm and 10 μm and can, with conventional methods, thus be designed in color only with difficulty.

In the variant of the present invention shown in FIG. 15(*a*), the region of the micromotif elements 150 includes metallic nanoparticles 152 that are embedded in a carrier medium 154, as described above in greater detail. The micromotif elements 150 in FIG. 15(*b*) are filled with a linear subwavelength grating 156, and the micromotif elements 150 shown in FIG. 15(*c*), with a quadratic cross-line grating 158.

The color production or blackening is accomplished by the excitation of plasmons in the respective nanopatterns 152, 156, 158, as already described above. In the case of the filling with the line grating 156, whose period should be significantly smaller than the wavelength of visible light, in addition to the color effect, also a polarizing effect will be observed. Which color, in detail, is created depends on the composition of the nanopatterns and the type of dielectric embedding, as already explained in detail. The deterministic patterns 156, 158 in FIGS. 15(*b*) and (*c*) can be manufactured through embossing in UV lacquer and subsequent vapor deposition of a metal layer of suitable thickness. If necessary, instead of a simple metal layer, also a layer system can additionally be applied, as described above, for instance to additionally amplify the plasmonic color effects.

In the profile shapes created, the areal sections provided with nanopatterns can be located on the plane of the vellum region or be offset downward or upward compared with this plane. Typical embossing depths are in the range between 10 nm and 500 nm for the nanopatterns and up to a maximum of 10 μm for the micropatterns.

Furthermore, the regions that are offset upward or downward and that define the areas of the micromotif elements 150 can also exhibit curved profiles.

In the depictions in FIG. 15, the vellum region consists of an unpatterned, smooth surface, while the areas that form the micropatterns are furnished with nanopatterns. However, the reverse case is also possible in that the micropatterns undergo no additional patterning, but rather the surrounding vellum region is nanopatterned. As shown in the exemplary embodiment in FIG. 16, also a combination of both possibilities may be considered, in which both the micromotif elements 160 and the surrounding vellum region 162 are provided with nanopatterns 164, 166 that each achieve different color effects.

In addition to the embodiments described so far, the nanopatterns can also change within a micropattern, for example continually, abruptly or statistically. The same applies for the nanopattern filling of the vellum region: it, too, need not necessarily be homogeneous, as shown in the exemplary embodiments in FIGS. 15 and 16. Also the areal sections that include no nanopatterns can be unpatterned or filled with other patterns. For this, micropatterns, such as sawtooth patterns or retroreflective cube-corner patterns, or so-called moth-eye patterns that absorb light and thus look dark to black, may, for example, be considered.

The invention claimed is:

1. A security element for security papers, value documents and the like, comprising:

a feature region that selectively influences incident electromagnetic radiation and that includes metallic nanopatterns in which volume or surface plasmons are excited and/or resonance effects are caused by the incident electromagnetic radiation, characterized in that the feature region includes, as metallic nanopatterns, one or more subwavelength gratings each having a grating period below the wavelength of visible light, wherein the subwavelength gratings are formed as binary patterns that include exclusively planar metallic areal sections on only two different height levels;

characterized in that the feature region includes micropatterns having a line width between about 1 μm and about 10 μm, where the micropatterns form a motif image that is subdivided into a plurality of cells, in each of which are arranged depicted regions of a specified target image the lateral dimensions of the depicted regions being between about 5 μm and about 50 μm, especially between about 10 μm and about 35 μm, characterized in that a viewing grid is provided, composed of a plurality of viewing grid elements for reconstructing the specified target image when the motif image is viewed with the aid of the viewing grid, the lateral dimensions of the viewing grid elements being preferably between about 5 μm and about 50 μm, especially between about 10 μm and about 35 μm.

2. The security element according to claim 1, characterized in that the feature region selectively influences incident electromagnetic radiation in the visible spectral range.

3. The security element according to claim 1, characterized in that the feature region selectively reflects and/or transmits incident electromagnetic radiation.

4. The security element according to claim 1, characterized in that the feature region is transparent or translucent.

5. The security element according to claim 1, characterized in that the feature region includes different metallic nanopatterns in different sub-regions.

6. The security element according to claim 1, characterized in that the subwavelength gratings exhibit a z-shaped metal profile.

7. The security element according to claim 1, characterized in that the subwavelength gratings are combined with a diffraction pattern that splits the incident electromagnetic radiation spectrally.

8. The security element according to claim 1, characterized in that the subwavelength gratings exhibit grating lines having a varying width.

9. The security element according to claim 1, characterized in that the subwavelength gratings exhibit a lateral variation in the grating profiles, especially a lateral variation in the profile depths, in order to produce laterally differing color impressions.

10. The security element according to claim 9, characterized in that the security element includes, composed of a plurality of pixel elements, a colored image in which, in each case, the grating profiles are constant within a pixel element, and the grating profiles of different colored pixel elements are differently developed in accordance with the respective color impression.

11. The security element according to claim 9, characterized in that the security element includes, composed of a plurality of pixel elements, a colored image in which the color impression of a pixel element is produced through color mixing of sub-regions having different grating profiles.

12. The security element according to claim 1, characterized in that the grating period of each of the subwavelength gratings is between 10 nm and 500 nm.

13. The security element according to claim 1, characterized in that the subwavelength gratings are formed by linear gratings.

14. The security element according to claim 1, characterized in that the subwavelength gratings are formed by two-dimensional cross-line gratings that are periodic in one or two spatial directions.

15. The security element according to claim 1, characterized in that the subwavelength gratings are formed by curved one- or two-dimensional gratings having a continually changing azimuth angle of the grating lines.

16. The security element according to claim 1, characterized in that the subwavelength gratings are formed by repeated one- or two-dimensional arrangement of metallic pattern elements.

17. The security element according to claim 16, characterized in that the metallic pattern elements are formed in the shape of squares, rectangles, circular areas, ring patterns, strips, spheres, rhombuses, rods, open rings or a combination of these elements, or by elements of arbitrary shape.

18. The security element according to claim 1, characterized in that the subwavelength gratings are integrated in an interference layer system.

19. The security element according to claim 1, characterized in that the feature region is present in the form of patterns, characters or a code.

20. The security element according to claim 1, characterized in that the micropatterns form a motif image composed of a planar periodic or at least locally periodic arrangement of a plurality of micromotif elements.

21. The security element according to claim 20, characterized in that, for the moiré magnified viewing of the micromotif elements of the motif image, a planar periodic or at least locally periodic arrangement of a plurality of microfocusing elements is provided whose lateral dimensions are preferably between about 5 μm and about 50 μm, especially between about 10 μm and about 35 μm.

22. The security element according to claim 21, characterized in that the arrangement of micromotif elements and the arrangement of microfocusing elements each forms, at least locally, a two-dimensional Bravais lattice, the arrangement of micromotif elements and/or the arrangement of microfocusing elements forming a Bravais lattice having the symmetry of a parallelogram lattice.

23. The security element according to claim 1, characterized in that the observable color spectrum is influenced by an intensity shift due to a Wood's anomaly.

24. The security element according to claim 1, characterized in that, through linear or cross-shaped gratings, color effects are created due to the polarization direction of the incident light.

25. The security element of claim 1, wherein the one or more subwavelength gratings includes a first and second subwavelength grating, wherein the grating period of the first subwavelength grating is different from the grating period of the second subwavelength grating.

26. The security element of claim 1, each grating period having substantially constant spacing between adjacent grating lines of the particular grating period.

27. The security element of claim 1, each grating period having a curved grating such that the azimuth angle of the grating lines changes continually.

28. A method for manufacturing the security element according to claim 1, in which, in a feature region, the security element is provided with metallic nanopatterns in which volume or surface plasmons are excited and/or resonance effects are caused by the incident electromagnetic radiation, and as metallic nanopatterns, one or more subwavelength gratings each having a grating period below the wavelength of visible light are applied to a substrate;

characterized in that the feature region is formed having micropatterns having a line width between about 1 μm and about 10 μm, where the micropatterns form a motif image is produced that is subdivided into a plurality of cells, in each of which are arranged depicted regions of a specified target image, the lateral dimensions of the depicted regions being between about 5 μm and about 50 μm, especially between about 10 μm and about 35 μm, characterized in that a viewing grid is provided, composed of a plurality of viewing grid elements for reconstructing the specified target image when the motif image is viewed with the aid of the viewing grid, the lateral dimensions of the viewing grid elements being preferably between about 5 μm and about 50 μm, especially between about 10 μm and about 35 μm.

29. The method according to claim 28, characterized in that the feature region is provided with different metallic nanopatterns in different sub-regions.

30. The method according to claim 28, characterized in that a relief pattern is embossed in an embossing lacquer layer in the form of the desired subwavelength gratings, and a metalization is applied to the relief pattern.

31. The method according to claim 30, characterized in that the metalization is deposited at a deposition angle Q that is between 0° and 90°, preferably between 30° and 80°.

32. The method according to claim 30, characterized in that the metalized relief pattern is covered with a further lacquer layer.

33. The method according to claim 28, characterized in that the subwavelength gratings are applied having a lateral variation in the grating profiles, especially having a lateral variation in the profile depths.

34. The method according to claim 28, characterized in that, as a subwavelength grating, a repeated one- or two-dimensional arrangement of metallic pattern elements is applied to the substrate.

35. The method according to claim 34, characterized in that the subwavelength gratings are formed having pattern elements in the shape of squares, rectangles, circular areas, ring patterns, strips, spheres, rhombuses, rods, open rings or a combination of these elements, or elements of arbitrary shape.

36. The method according to claim 34, characterized in that the subwavelength gratings are formed having at least two pattern elements having different geometries.

37. The method according to claim 28, characterized in that the nanopatterns are produced by laser irradiation of a thin metal layer.

38. The method according to claim 28, characterized in that the feature region is produced in the form of patterns, characters or a code.

39. A security paper for manufacturing security or value documents, such as banknotes, checks, identification cards, certificates or the like, that is provided with the security element according to claim 1.

40. The security paper according to claim 39, characterized in that the security paper comprises a carrier substrate composed of paper or plastic.

41. The method of manufacturing of claim 28, each grating period having a substantially constant spacing between adjacent grating lines of the particular grating period.

42. The method of manufacturing of claim 28, each grating period having a curved grating such that the azimuth angle of the grating lines changes continually.

43. A data carrier, especially a branded article, value document or the like, having the security element according to claim 1.

44. The data carrier according to claim 43, characterized in that the security element is arranged in or over a window region or a through opening in the data carrier.

* * * * *